US007044126B2

(12) United States Patent
Gavriely

(10) Patent No.: US 7,044,126 B2
(45) Date of Patent: May 16, 2006

(54) DEVICE FOR PROVIDING PROTECTION TO THE RESPIRATORY SYSTEM

(76) Inventor: Oren Gavriely, 11a. Sinai Avenue, Haifa (IL) 34331

( * ) Notice: Subject to any disclaimer, the term of this patent is extended or adjusted under 35 U.S.C. 154(b) by 0 days.

(21) Appl. No.: 11/098,079

(22) Filed: Apr. 4, 2005

(65) Prior Publication Data

US 2005/0166916 A1 Aug. 4, 2005

(51) Int. Cl.
*A62B 19/00* (2006.01)

(52) U.S. Cl. ..... 128/201.25; 128/206.12; 128/201.23

(58) Field of Classification Search ..... 128/201.25, 128/201.22, 201.23, 201.29, 205.27, 205.29, 128/206.12, 206.13, 206.15, 206.17, 201.24
See application file for complete search history.

(56) References Cited

U.S. PATENT DOCUMENTS 2,821,192 A * 1/1958 Monro ..... 128/201.15
5,431,156 A * 7/1995 Sundstrom ..... 128/201.23
6,158,429 A * 12/2000 Gardner et al. ..... 128/201.25
6,340,024 B1 * 1/2002 Brookman et al. .... 128/201.25

* cited by examiner

*Primary Examiner*—Mital Patel

(57) ABSTRACT

A device for providing purified atmospheric air to a user. Air passes passively through a filter and partitions into a mouse-nose compartment and a face compartment. The air from the face compartment flushes a visor and subsequently passes into the mouse-nose compartment. A hood compartment sealed at the neck region and also around the face compartment. Unidirectional valves maintain the directional flow of air, and seal elements provide partitioning into compartments.

7 Claims, 5 Drawing Sheets

DEVICE FOR PROVIDING PROTECTION TO THE RESPIRATORY SYSTEM

TECHNOLOGICAL FIELD OF THE INVENTION

The present invention deals with the protection of the respiratory system against harmful airborne agents. More specifically a device of the invention is worn as a face mask used against industrial, environmental and military airborne hazardous agents.

BACKGROUND OF THE INVENTION

Since the first world war the threat of poisonous airborne agents has become a public concern. Further awareness regarding health hazards borne by the air is currently on the rise because of the general environmental conditions and occasional disasters caused by industrial exposures and accidental leaks.

Airborne hazardous agents are either true gasses or aerosols, containing noxious molecules or microorganisms. They penetrate the human body chiefly via the respiratory tract. The exposure of the upper and lower airways and the lung alveoli to toxic gases cause severe local and systemic reactions that rapidly lead to incapacitation and death. To prevent exposure of the lungs to toxic gases and biological agents, a variety of protective gear and barriers have been developed. In principle these devices include an impermeable shield around the face, the head, or the whole body, and means of supplying fresh and decontaminated air to sustain pulmonary gas exchange. The protective gear that is currently available may be subdivided into two primary classes: passive and active.

Passive protection refers to gas masks where the flow of air into the mask through the filter is driven by the kinetic energy provided by the user's own inspiratory system. Active protection refers to masks and other shields where the flow into the breathing circuit is driven by a pump or a blower. Active protection has the distinct advantages of being more effective by preventing penetration of the toxic gases through cracks or incomplete seal between the mask and the skin. This is achieved by running excess flow into the breathing circuit and maintaining positive pressure inside the shield at all times. Active protection gear is also safer since it assures, at all times, ample supply of fresh air, free of carbon dioxide and rich in oxygen. Additional advantage of active gear is the avoidance of excessive negative pressures needed to generate flow through the filter, especially during strenuous activity, when peak inspiratory flow is elevated.

The disadvantages of active protective gear are their higher cost, their reliance on a power source such as batteries, their increased weight, their susceptibility to breakage and malfunction and their complexity. Of particular concern are the durability and shelf life of the batteries. The invention disclosed herewith is of a gas mask that is primarily of the passive type.

Additional classification of protective gear relates to the location of the seal in relation to the user's skin. There are four types of mask seals: 1) the face mask, sealed around the user's face; 2) the mouth-nose mask, sealed only around the respiratory inlets; 3) the hood protective gear that is sealed around the neck; and 4) the hybrid double seal device that is constructed from an external hood or face mask and an inner mouth-nose compartment that is sealed around the mouth and nose.

The face type gas mask is the standard model used by the military, such as the M40 used by the US army. It covers the mouth, nose and eyes and has a relatively large dead space. The seal of this mask is around the face from the forehead around the maxillae and cheeks down to below the chin.

This seal of the facemask must fit snugly to prevent leakage of toxic gases into the mask. This seal is not applicable in specific cases. For example beard wearers, or individuals with unusual facial proportions or deformations. In addition, the facemask requires individual sizing and meticulous adjustment of the pull-straps that hold the mask to the face. A common variant of the facemask, such as disclosed by Grove, Chase and Fritch in U.S. Pat. No. 6,176,239, includes an additional mouth-nose compartment inside the face mask. This compartment is also intended to fit snugly around the nose and mouth to reduce re-breathing of carbon dioxide and fogging of the mask lenses.

The mouth-nose mask only protects the user's respiratory inlet and requires separate goggles to protect the eyes. As such, it is not suitable for general protection against chemical and biological warfare, but is often used in industry where light weight and convenience are important and the level of exposure risk is well-known in advance.

The third type is the hood protection gear that is sealed around the user's neck. This hood can only be used as an active mask because of its large dead space and compliant walls that promote carbon dioxide retention if a pump or blower is not used.

The fourth type is the hybrid double seal device. Such a mask includes a mouth-nose compartment that fits the user's face snugly and an enclosing hood fitted with a visor and a membrane sealing it around the user's neck. This type of gear provides a high protection ratio, but is only safe to use if the mouth-nose compartment is tightly sealed. If the seal is incomplete or breaks as a result of head motion, speech or other movements, carbon dioxide-rich exhaled gas escapes into the hood cavity and is re-breathed during the subsequent inhalation. Such re-breathing may cause carbon dioxide build-up and suffocation.

Further classification of gas masks relates to the different user grouping. In essence, there are two subgroups: 1) masks intended for active personnel such as emergency crews and military personnel and 2) masks intended for sedentary civilian population. There are differences in design and construction as well as in distribution strategy for the two subgroups. The masks for civilian population are usually distributed with only rough individual customization (i.e., 'large', 'medium', 'small'). They must be very simple to use with only minimal training (eg., a video tutoring film). Moreover, the system must be both effective and safe beyond doubt for the vast majority of people. Thus, it should provide adequate protection while being safe under multitude of circumstances. Safety criteria include upper threshold for inhaled carbon dioxide level ($F_1CO_2$) that must be less than 2% and a minimum value of inhaled oxygen ($F_1O_2$) that must be greater than 17%. These thresholds must not be violated for a period that is continuously longer than sixty seconds. The novel chemical-biological protection gear disclosed herewith is specifically intended for use by such untrained, diverse civilian populations.

The final subdivision of protective gear is by the placement and configuration of the inlet and outlet respiratory valves. In all gas masks the exhalation outlet forms a direct communication with the mouth-nose compartment so that the exhaled gas can exit the system easily and promptly.

The placement of the inhalation valve(s) varies among gas masks, but in most systems including an inner mouth-nose compartment, there are two sets of inspiratory valves: 1) a valve leading from the filter into the cavity of the outer shell and 2) a valve or valves leading from the outer shell into the mouth-nose compartment. The advantage of this configuration is that fresh air flushes the interior of the outer shell with every breath. This is most useful in keeping moisture from condensing on the lenses or visor elements of the mask. The disadvantage of this arrangement is that exhaled gas that may escape under the seal from the mouth-nose compartment into the shell mixes with the fresh gas and causes partial re-breathing of a carbon dioxide-rich and oxygen-poor gas.

Placement of the inhalation valve directly in communication with the mouth-nose compartment is found in industrial mouth-nose masks where independent goggles are used for eye protection. When used in a facemask variant that does not have a sealed mouth-nose compartment, the internal volume becomes too large (i.e., 500 ml.) creating an excessive respiratory dead space, which may be too large for persons with small lung capacity.

DETAILED DESCRIPTION OF THE INVENTION

The novel protection system described hereinbelow is a passive masking device for isolating the respiratory system of a user from airborne gases and or aerosols. It is constructed of three compartments, a hood which is sealed around the neck, a facemask sealed around the face and a mouth-nose chamber sealed around the respiratory inlet.

Figure 1:
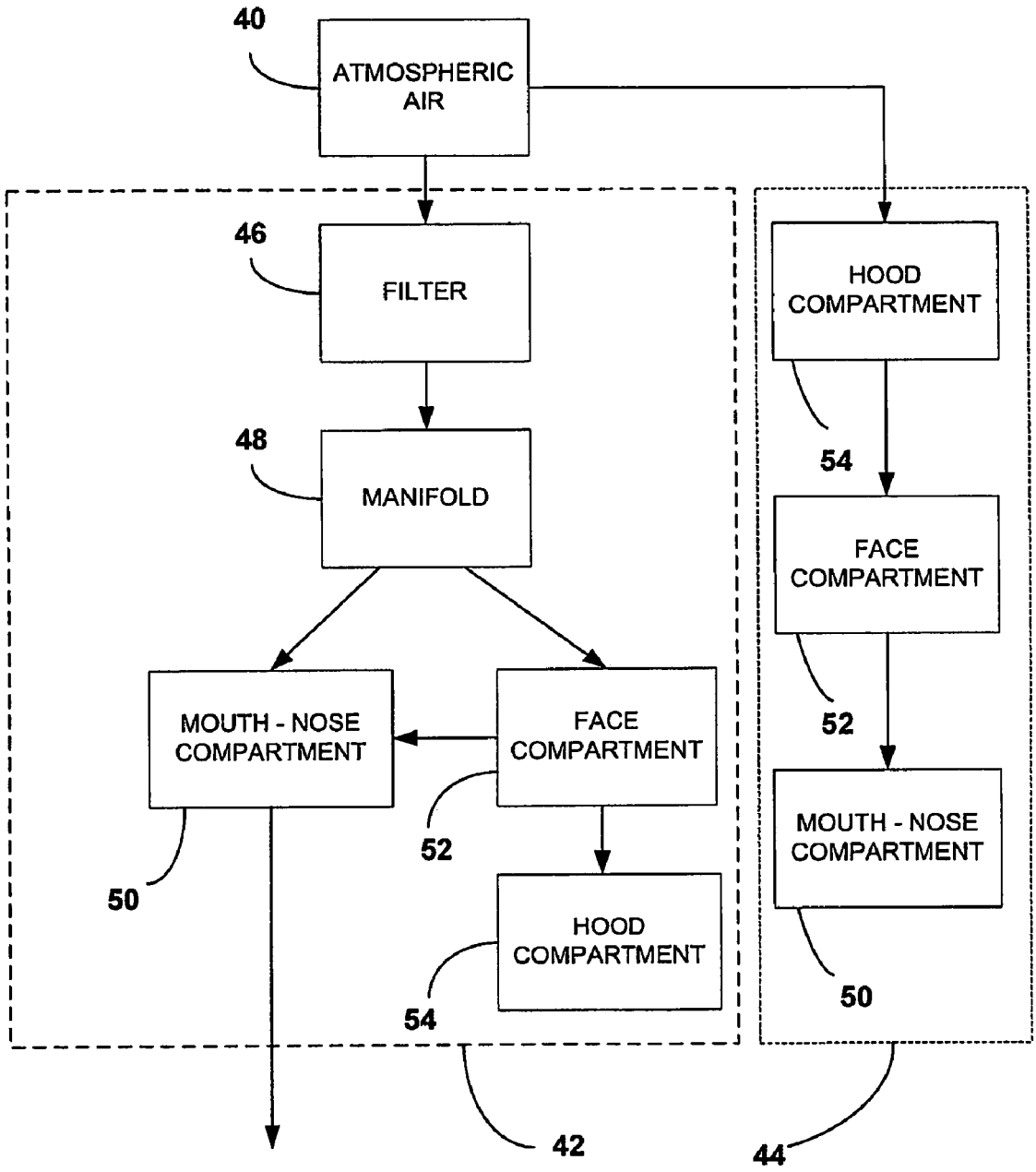
FIG. 1 is a block diagram describing the flow of air between compartments of a device of the invention.

FIG. 1 is a block diagram describing schematically the airflow channels in a protective device embodying the present invention. The atmospheric air 40 comes in contact with the wearer of the device of the invention, through either of two paths or both. In path 42 the air passes through a filter before it comes into contact with the user as will be explained below. In path 44 a small amount of air penetrates a seal that seals off a hood compartment to further, residually reach the wearer. To prevent atmospheric air from contacting the user and air exhaled by the user from filling the compartments, passage of air between the compartments is controlled by a series of seals and unidirectional valves, as will be described below. Atmospheric air 40 passes through filter 46 and then into manifold 48. From the manifold 48, the airflow partitions into either the mouth-nose compartment 50 through a unidirectional valve, or the face compartment 52 through a unidirectional valve, the proportion of airflow into each compartment can be regulated or preset. After flushing the face compartment 52, air passes through a directional valve, to the mouth-nose compartment 50. From the mouth-nose compartment 50 the air is emitted to the ambient atmosphere through directional valve. In path 44, a seal, typically closing on the neck, almost totally prevents penetration of atmospheric air 40 into the hood compartment 54. Another seal almost totally prevents passage of air from the hood compartment 54 to face compartment 52. A seal almost totally prevents passage of air from the mouth-nose compartment 50 to the face compartment 52 and vice versa.

Figure 2:
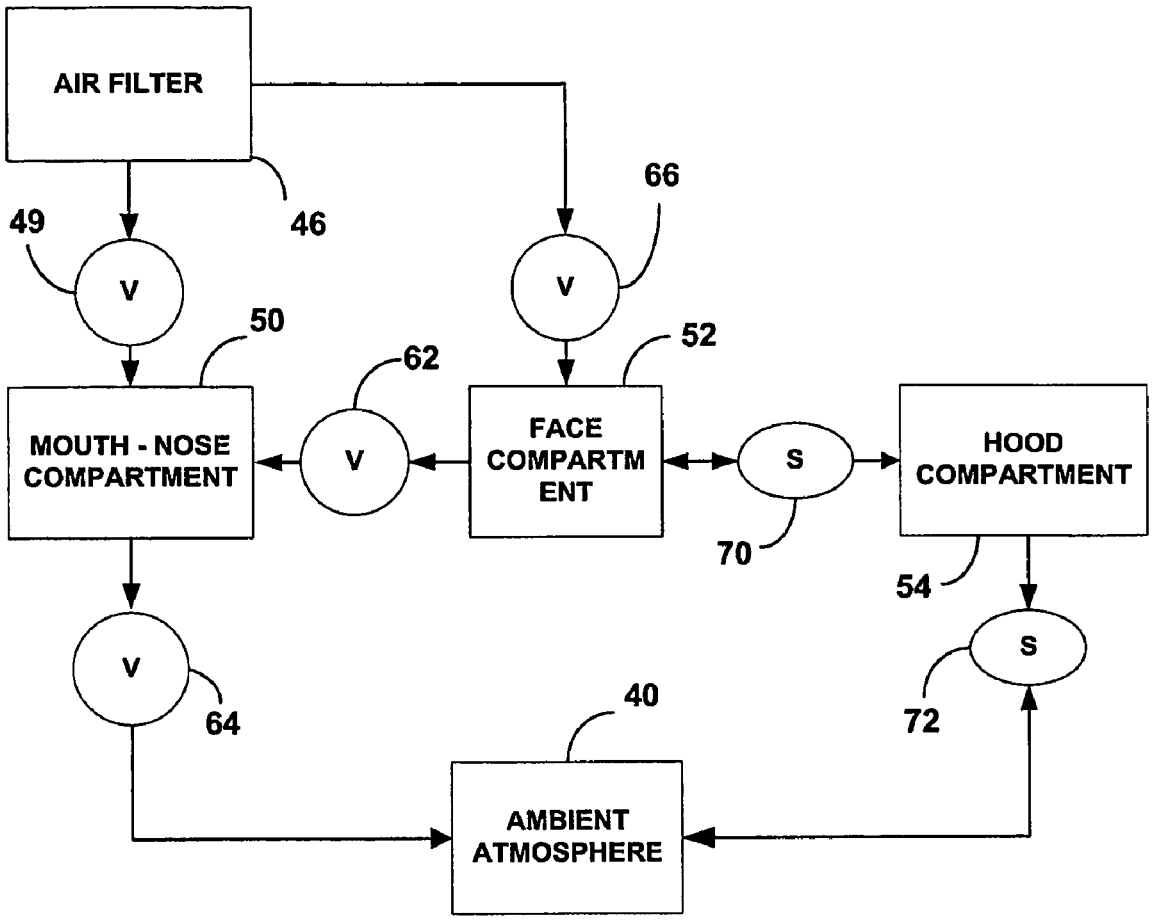
FIG. 2 is is a block diagram describing the barring components of flow of air between compartments of a device of the invention.

To prevent ambient atmospheric air from contacting the user and air exhaled by the user from filling the compartments, passage of air between the compartments is controlled by a series of seals and unidirectional valves, as will be described below. FIG. 2 is a block diagram describing the topology of the restrictive elements of air-movement employed in a device of the invention: seals and unidirectional valves. Air from the face compartment 52 is driven through unidirectional valve 62 to mouth-nose compartment 50 also receives air directly from air filter 46 through valve 49. From mouth-nose compartment 50 the air is driven through unidirectional valve 64 to the ambient atmosphere 40. The face compartment 52 receives air from air filter 46 through valve 66. The mouth-nose compartment 50 Residual amounts of air are transferred across seal 70. Hood compartment 54 also interacts with the ambient atmosphere through seal 72.

Figure 3:
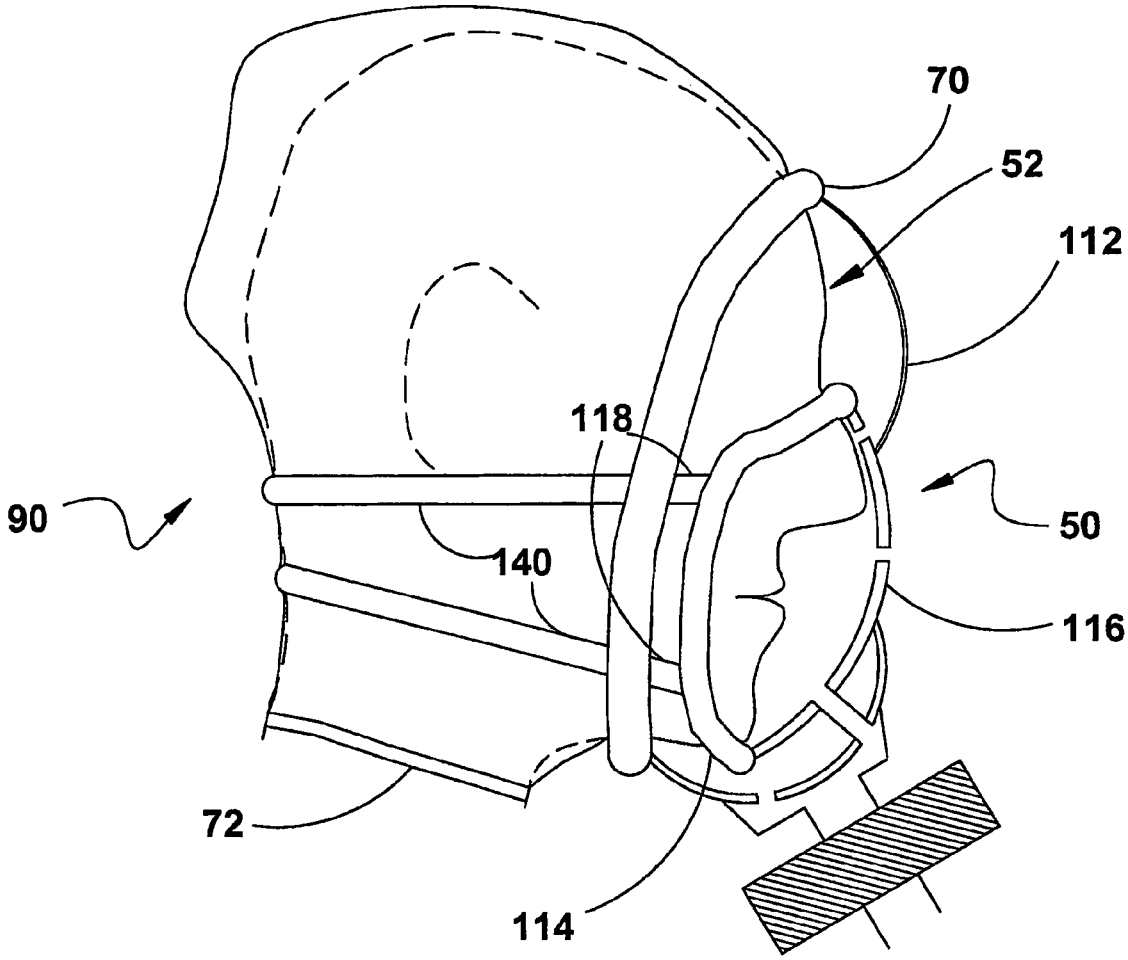
FIG. 3 is a side view and partial cross section of the gas mask of the invention worn by a user.

A mask in accordance with the present invention provides protection against gasses and aerosols containing chemical and or biological hazardous agents. The novel structure minimizes the occurrence of re-breathing of the exhaled $CO_2$— rich and $O_2$— poor air by the user. FIG. 3 describes schematically a side view of a device of the invention and its major components. Hood 90, covers the head of the wearer and is sealed by a neck seal 72 and at the front of the head by seal 70. Visor 112 connects to seal 70 and to mouth-nose compartment 50. The mouth-nose compartment has a rim 114 that typically fits snugly around the bridge of the nose, its sides, the cheek bones, the cheeks and the chin. The rim forms a seal and minimizes air interchange with the face compartment 52. The mouth-nose compartment 50 preferably has a minimal volume in order to minimize the volume of exhaled air lingering inside the compartment. The wall 116 of the mouth-nose compartment is in a preferred embodiment of the invention made from a semi-rigid material such as silicon. The front wall of the mouth-nose compartment 50 is sufficiently flexible to permit some measure of flexibility for better fit and comfort. The mouth-nose compartment 50 contains several air passageways as will be explained later on. The hood compartment consists of a complete cover of the head typically made from impermeable flexible material. In a preferred embodiment of the invention, a set of straps 118 keeps the mouth-nose compartment tightly held against the skin. The straps are preferably attached to the sides and top of the hood. The straps are guided through a channel or loop to prevent tangling and facilitate their tightening around the head. In a preferred embodiment of the invention the straps are attached to an anchoring strip on the external surface of the hood 90. The anchoring strip is connected internally to elastic straps 118 that connect to the rim 70 and to the rim of mouth-nose compartment 114. Thus, pulling the external straps 140 pulls the face compartment and the mouth-nose compartment tighter to the skin of the face.

Figure 4:
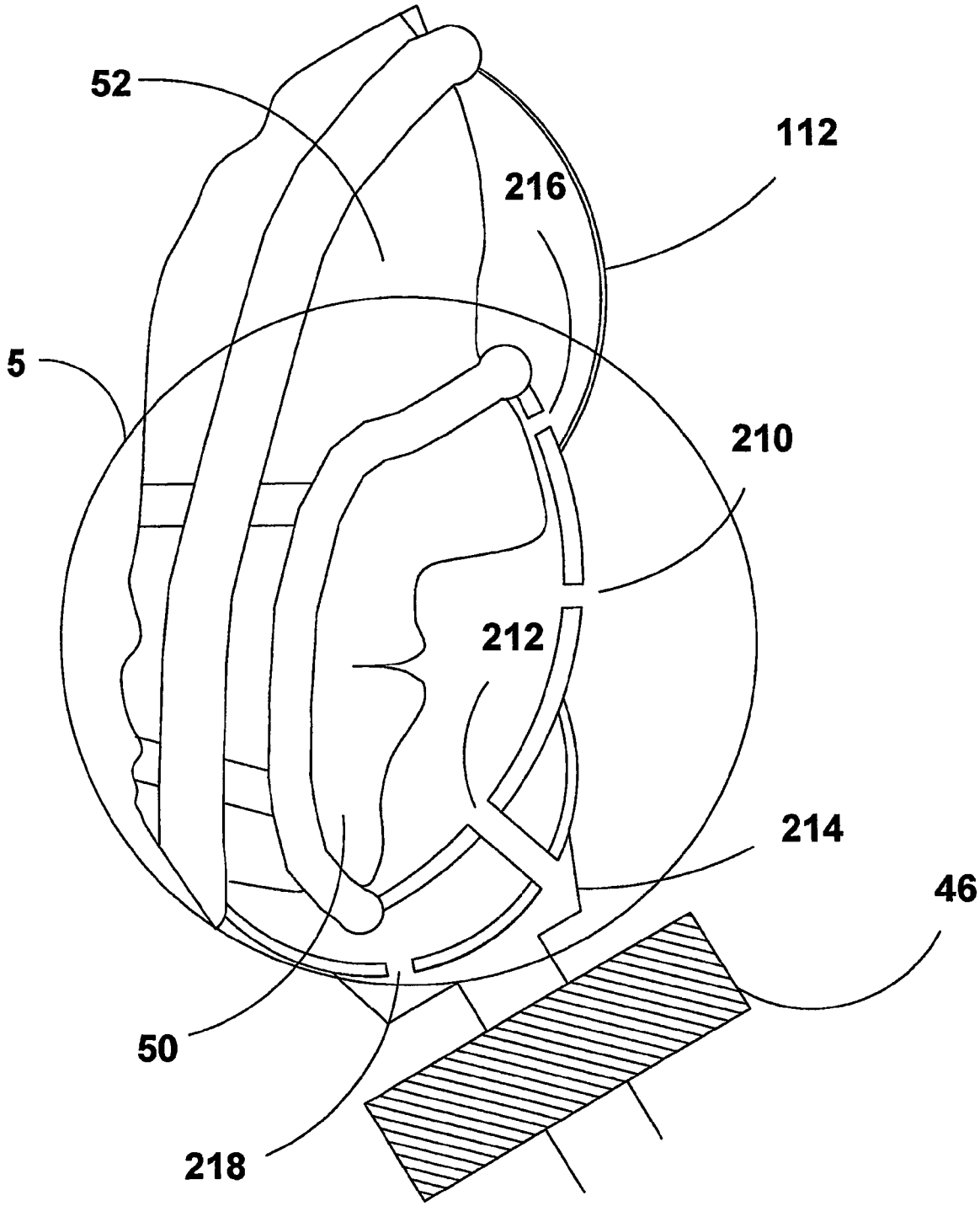
FIG. 4 is a side view and partial cross section of a front portion of the gas mask of the invention worn by a user.

In FIG. 4 the portion of a mask is shown, indicating the air passageways of the device of the invention. The exhalation passageway 210 permits ridding of the exhaled gas. The primary inhalation passageway 212 connects between the manifold 214 and the mouth-nose compartment 50. In addition, one or more air passageways 216 connect between the face compartment 52 and the mouth-nose compartment 50. Air passageway 218 also implements a direct connection between these two compartments. Air may thus enter the mouth-nose compartment either directly from the filter 46 via the manifold 214 or indirectly from the filter and manifold through the inner cavity of the face compartment 52. This partitioning of incoming air facilitates intake of mostly fresh air, with a concomitant flushing the interior of the face compartment to prevent fogging of the visor 112 or build up of $CO_2$ if there is a leak under the seal of the mouth-nose compartment.

Figure 5:
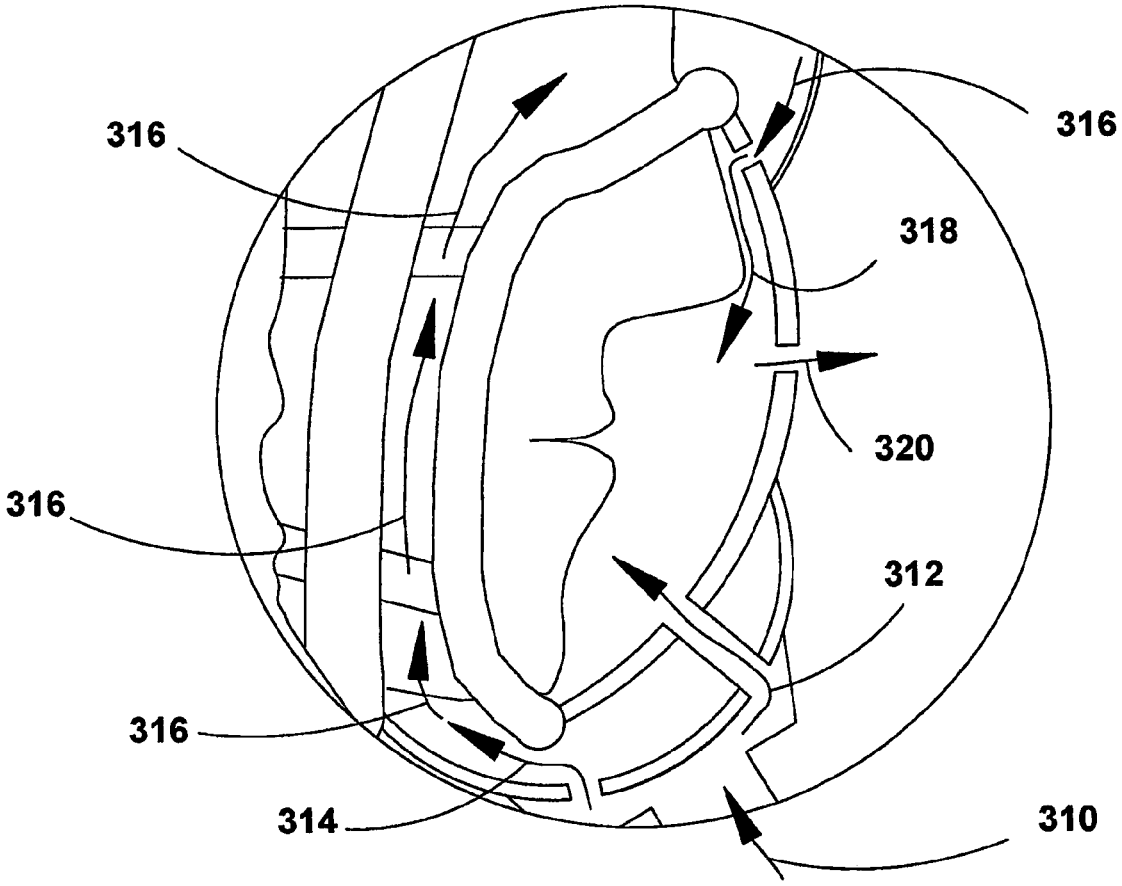
FIG. 5 is a is a side view and partial cross section of a front portion of the gas mask of the invention worn by a user showing air flow directions.

The seals of the mouth-nose compartment and the face compartment consist of a semi-rigid outer wall that forms an airtight seal with the skin. This is accomplished through a contoured rim, gas filled cushion, liquid filled cushion or a jell filled cushion, without barring the motion of the mandible for speech and drinking. A detailed description of the airflow inside the facial portions of the device of the invention is provided in FIG. 5 to which reference is now made. Purified air flows in the direction of arrow 310 from the air filter. Air then flows in two passageways, one indicated by arrow 312 to the mouth-nose compartment, and in parallel as indicated by arrow 314 to the face compartment. In the face compartment, the air flows in the direction of arrows 316 until it enters the mouth-nose compartment as indicated by arrow 318. In its way, the air flows past the visor and diminishes fogging and condensation. Finally air exited through a passageway in the direction of arrow 320.

The invention claimed is:

1. A passive system for protecting the respiratory system of a user in which incoming atmospheric air is filtered prior to contacting the user and wherein contact with non filtered atmospheric air by the user is repressed, said system comprising: a manifold for supplying filtered air to a mouth-nose compartment and to a face compartment, the manifold defining a divided air passage whereby filtered air is divided and supplied directly to each of the mouth-nose compartment and the face compartment;

an air passageway for passing air from the face compartment to said mouth-nose compartment;

an air passageway for letting out air from said mouth-nose compartment into the ambient atmosphere;

a hood compartment continuous with the rim of said face compartment and having an air-tight seal with the face at its anterior rim;

an air-tight seal of said hood compartment with the neck of said user, and wherein said air passageways comprise unidirectional valves.

2. A passive system for protecting the respiratory system of a user as in claim 1 and wherein the contact of said mouth-nose compartment with the skin is air-tight.

3. A passive system for protecting the respiratory system of a user as in claim 1 and wherein said mouth-nose compartment is strapped to adjustably strengthen the seal with the face.

4. A method for supplying filtered atmospheric air passively to the face and to the respiratory system, comprising: partitioning incoming filtered air to a face compartment and to a mouth-nose compartment; flushing said face compartment by said incoming air; passing air to said mouth-nose compartment, and letting used air out of said mouth-nose compartment into the atmosphere.

5. A method for supplying filtered atmospheric air passively to the face and to the respiratory system as in claim 4 further comprising restricting entrance of air from a hood compartment to said face compartment.

6. A passive system for protecting the respiratory system of a user in which incoming atmospheric air is filtered prior to contacting the user and wherein contact with non-filtered atmospheric air by the user is repressed, said system comprising: a manifold that supplies filtered air to a mouth-nose compartment and to a face compartment; a first air passageway that passes air from the face compartment to said mouth-nose compartment; a hood compartment continuous with the rim of said face compartment and having an air-tight seal with the face at its anterior rim; an air-tight seal of said hood compartment with the neck of said user; and a second air passageway that lets out air from said mouth-nose compartment directly into the ambient atmosphere; and wherein said air passageways comprise unidirectional valves.

7. A method for supplying filtered atmospheric air passively to the face and to the respiratory system, comprising the steps of: partitioning incoming filtered air; flushing said face compartment by a first portion of said partitioned incoming air; passing another portion of said partitioned incoming air to said mouth-nose compartment; and letting used air out of said mouth-nose compartment directly into the atmosphere.

* * * * *